US005619194A

United States Patent [19]

Belfer

[11] Patent Number: 5,619,194

[45] Date of Patent: Apr. 8, 1997

[54] FIBER OPTIC TRAFFIC SIGNAL LIGHT SYSTEM HAVING A SHUTTER CONTROL

[76] Inventor: Bruce D. Belfer, 6 Barbara La., Ocean, N.J. 07712

[21] Appl. No.: 608,180

[22] Filed: Feb. 28, 1996

Related U.S. Application Data

[63] Continuation-in-part of Ser. No. 284,932, Aug. 2, 1994, Pat. No. 5,563,588.

[51] Int. Cl.[6] ..... G08G 1/095

[52] U.S. Cl. ..... 340/907; 340/916; 340/927; 340/930; 340/815.42; 340/815.64; 340/815.75; 362/32

[58] Field of Search ..... 340/907, 916, 340/927, 930, 815.42, 815.43, 815.45, 815.64, 815.68, 815.75, 815.76; 362/32, 800

[56] References Cited

U.S. PATENT DOCUMENTS

| | | | |
|---|---|---|---|
| 4,684,919 | 8/1987 | Hihi | 340/907 |
| 4,924,612 | 5/1990 | Kopelman | 40/547 |
| 5,387,908 | 2/1995 | Henry et al. | 340/916 |

*Primary Examiner*—Brent A. Swarthout
*Assistant Examiner*—Daryl C. Pope
*Attorney, Agent, or Firm*—Ezra Sutton

[57] ABSTRACT

The system includes a high-intensity light source, a fiber optic conduit for transmitting a light-beam, and colored lenses, which emit red, yellow, and green light on fiber optic lines. Each traffic light has a shutter and control means for opening and closing the shutters in the proper sequence for preset time periods to control red, yellow, and green lights.

3 Claims, 13 Drawing Sheets

500

FIBER OPTIC TRAFFIC SIGNAL LIGHT SYSTEM HAVING A SHUTTER CONTROL

RELATED APPLICATION

This application is a continuation-in-part of application Ser. No. 08/284,932, filed on Aug. 2, 1994, now U.S. Pat. No. 5,563,588.

FIELD OF THE INVENTION

The present invention relates to a traffic signal light control system employing fiber optic lighting, colored lenses, and a shutter system for supplying light to the traffic signal lights.

BACKGROUND OF THE INVENTION

In present traffic signal lights, the illumination is normally supplied by multiple low-intensity light sources. Such an arrangement is energy inefficient, is costly to maintain due to the need to change bulbs often, and is generally expensive to maintain.

DESCRIPTION OF THE PRIOR ART

Traffic signal lights of different designs have been disclosed in the prior art. For example, U.S. Pat. No. 4,684,919 to B. Hihi discloses an apparatus which relates to a light source multiplication device for use as a traffic signal, warning signal, and/or lighted sign. Light-emissive diodes (LEDs) are used as a light source, and a prism and mirrors are used to multiply the transmitted light. This patent does not teach the use of fiber optics in traffic lights or the use of a switching control system for controlling shutters which provide given colored lights in a preset timed sequence.

U.S. Pat. No. 4,924,612 discloses an apparatus that uses fiber optics in a traffic signal, warning signal, guide light, and/or lighted signs. It discloses a multilight source, a fiber optic cable, and a fiber optic plastic having light-conveying channels which go into a configuration-forming structure, such as a traffic light. This patent discloses fiber optic cables which lead from the respective multilight sources to illuminate the red, yellow, and green plastic members. A plurality of light sources are used for each set of red, yellow, and green lights. This patent does not show the use of shutters or a switching control device for controlling the shutters.

Accordingly, it is an object of the present invention to provide a fiber optic traffic signal light system that uses a single high-intensity light source in combination with a convergence lens to optimize and provide an efficient light source output.

It is another object of the present invention to provide a multicabled conduit having a plurality of fiber optic lines for the transmission of the single high-intensity light source in an efficient, effective, and economical manner.

It is another object of the present invention to provide a color multiplexer device having plastic, dichroic, or glass lenses of red, yellow, and green color, which enhances the colored light illumination to an optimal lighting level.

It is another object of the present invention to provide a fiber optic traffic signal light that has a single signal display window for illuminating a red, yellow, or green light signal.

It is another object of the present invention to provide a more compact and lightweight fiber optic traffic signal light.

It is another object of the present invention to provide a fiber optic traffic signal light that uses a rotating lens wheel for controlling the source of red, yellow, and green light being transmitted to the plurality of signal displays.

It is another object of the present invention to provide a fiber optic traffic signal light that uses a movable lens shutter for controlling the source of red, yellow, and green light being transmitted to the plurality of signal displays.

It is another object of the present invention to provide a fiber optic traffic signal light that uses only red and green fiber optic lenses to produce a light beam source of red, yellow, and green light for transmission to a plurality of signal displays.

It is another object of the present invention to provide a fiber optic traffic signal light that has fiber optic directional displays for left and right turns.

It is another object of the present invention to utilize conventional traffic light switching control systems for controlling a plurality of shutters which open and close to provide colored light in a predetermined sequence. This maximizes the flow of vehicular and pedestrian traffic for a given direction while minimizing any possible traffic congestion for a given traffic intersection location.

A still further object of the present invention is to provide a fiber optic traffic signal light system with a shutter switching control having a logic circuit that is easy to maintain and which minimizes labor costs and costs of parts.

SUMMARY OF THE INVENTION

In accordance with the principles of the present invention, there is provided a fiber optic traffic signal light system which utilizes a conventional switching control microprocessor for controlling fiber optic light by a plurality of shutters.

The light source is a high-intensity discharge lamp with a convergence lens, which provides a high-intensity light beam. The high-intensity light is projected onto a fiber optic conduit having three optic cables. Each fiber optic cable is connected to a multiplexer having red, yellow, and green fiber optic lenses for transmitting enhanced colored beams of light from within the color multiplexer and lens unit. The multiplexer transmits four red color light beams, four yellow color light beams, and four green color light beams.

These twelve fiber optic lines are connected to four traffic signal lights which face the north, east, south, and west at a particular intersection. Each traffic signal light has a set of red, yellow, and green signal lights contained within. In a standard manner, the red, yellow, and green lights control the movement and flow of vehicular and pedestrian traffic.

The signal light control system utilizes the conventional switching control microprocessor for controlling a plurality of shutters to open and close in a predetermined time sequence. In one embodiment, each traffic light has three shutters attached thereto, which provides the north/south and east/west traffic lights with the same color light signals when in use.

The present invention includes one high-intensity light source that supplies light through twelve or more fiber optic cables which, in turn, supplies light to four traffic light signals having four sets of signal lights of red, yellow, and green. It also includes a switching control system for controlling shutters for the conventional switching of traffic light signals by a microprocessor solid-state circuit board.

In another embodiment of the present invention, there is provided a fiber optic traffic signal light that uses a single signal display window for illuminating a red, yellow, or green light signal from within the traffic light housing.

In another embodiment of the present invention, there is provided a traffic signal light housing that is more compact and lightweight than standard traffic light housings.

In another embodiment of the present invention, there is provided a fiber optic traffic signal light having a switching control system that has a logic circuit for controlling a rotatable lens wheel, which transmits a red or yellow or green color light beam to a plurality of signal displays.

In another embodiment of the present invention, there is provided a fiber optic traffic signal light having a switching control system that has a logic circuit for the controlling of a movable lens shutter, which then transmits a red or yellow or green color light beam to a plurality of signal displays.

In another embodiment of the present invention, there is provided a fiber optic traffic signal light that has red and green lenses only, which produce the three (3) required colors of red, yellow, and green for signal light displaying.

In another embodiment of the present invention, there is provided a fiber optic traffic signal light that has fiber optic directional display arrow for a vehicle to make a left or right turn.

BRIEF DESCRIPTION OF THE DRAWINGS

Further objects, features, and advantages of the present invention will become apparent upon the consideration of the following detailed description of the presently-preferred embodiment when taken in conjunction with the accompanying drawings, wherein.

DETAILED DESCRIPTION OF THE PREFERRED EMBODIMENTS

DETAILED DESCRIPTION OF FIG. 3 SHOWING THE FIRST EMBODIMENT

Figure 1:
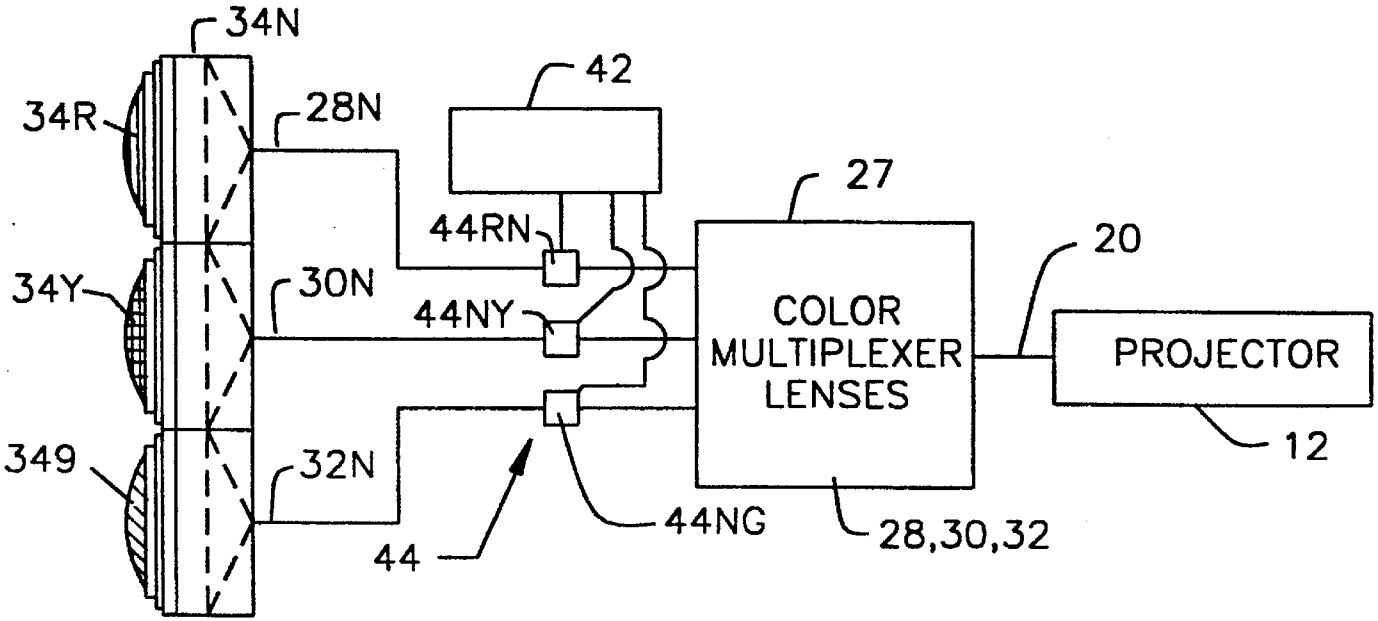
FIG. 1 is a schematic diagram of the first embodiment of the present invention showing an individual traffic signal light in a side view, together with its circuitry, switching control with shutters, color multiplexer, and light projector.
Figure 2:
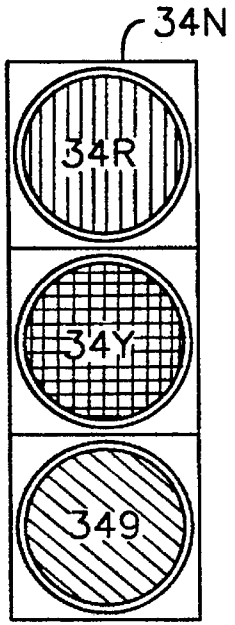
FIG. 2 is a front view of the traffic signal light shown in FIG. 1.
Figure 3:
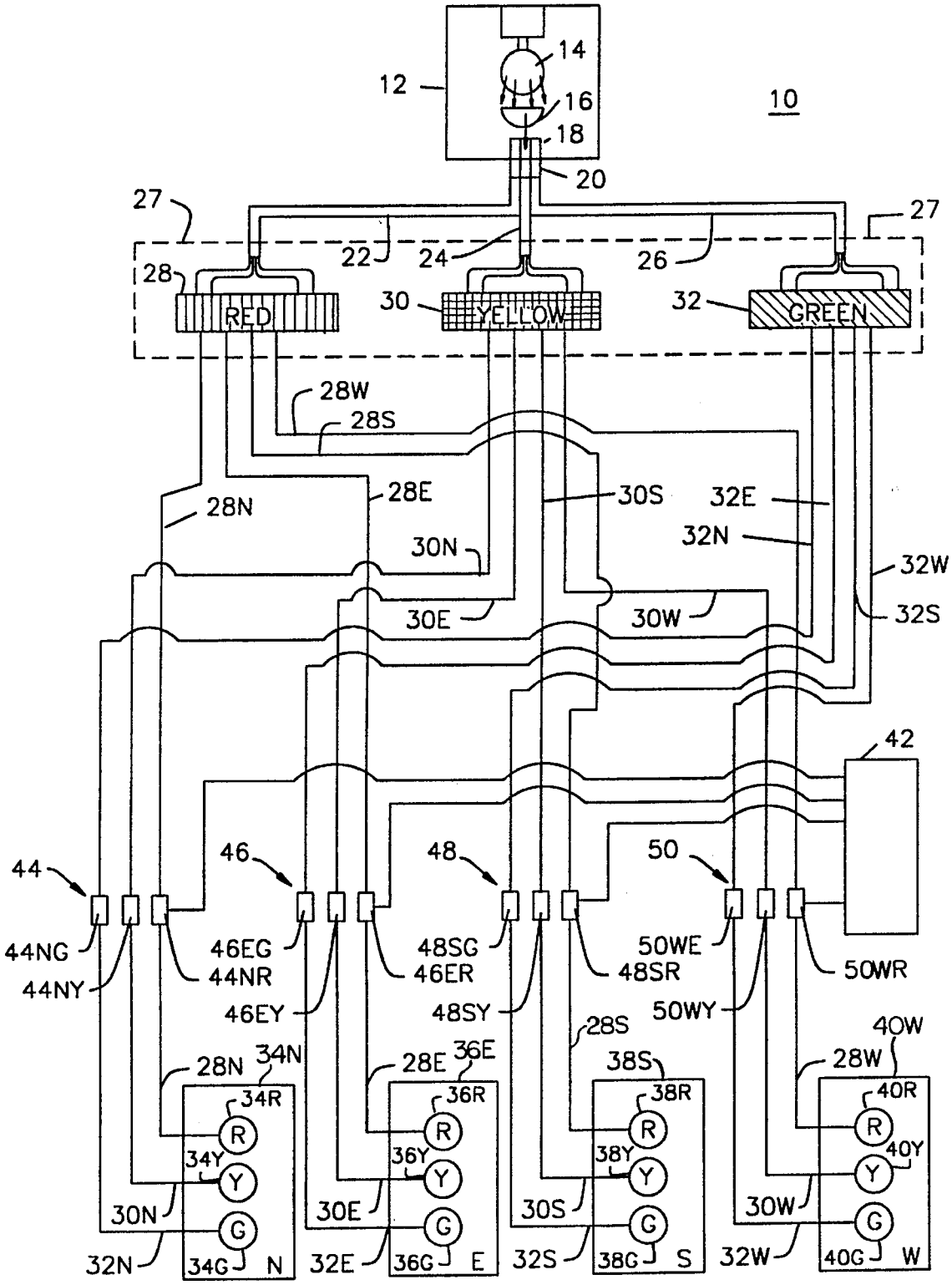
FIG. 3 is a schematic diagram of the first embodiment of the present invention showing the transmission of a light source to a plurality of fiber optic lines that transmit red, yellow, and green color light beams that connect to a plurality of traffic light signals.

As shown in detail in FIGS. 1 to 3 of the present invention, the fiber optic traffic signal light control system 10 includes a projector light source 12 having a high-intensity discharge lamp 14, preferably of 70 watts, and a convergence lens 16, which provides a high-intensity light beam 18. Beam 18 is projected onto a fiber optic conduit 20 having three fiber optic cables 22, 24, and 26 contained therein. Each fiber optic cable 22, 24, and 26 is then connected to a red, yellow, and green dichroic lens or a standard plastic lens 28, 30, and 32, respectively. From each red, yellow, and green lens 28, 30, and 32, there are four separate colored fiber optic lines. More particularly, fiber optic lines 28N, 28E, 28S, and 28W transmit red color light beams, fiber optic lines 30N, 30E, 30S, and 30W transmit yellow color light beams, and fiber optic lines 32N, 32E, 32S, and 32W transmit green color light beams.

The above fiber optic lines, twelve in number, are connected to four traffic signal lights 34N, 36E, 38S, and 40W, which represent the north, east, south, and west position of each traffic light at a particular intersection. The traffic lights 34N, 36E, 38S, and 40W have red signal lights 34R, 36R, 38R, and 40R, yellow signal lights 34Y, 36Y, 38Y, and 40Y, and green signal lights 34G, 36G, 38G, and 40G. In a conventional manner, the red, yellow, and green lights control the movement and flow of traffic for vehicles and pedestrians. It should be noted a traffic signal light refers to one set of red, yellow, and green lights.

In signal light control system 10, there is a switching control microprocessor 42 for controlling a plurality of shutters 44, 46, 48, and 50 to open and close in a predetermined timed sequence. Each traffic light 34N, 36E, 38S, and 40W has three shutter units connected thereto, as shown in detail in FIG. 3. The north traffic light 34N is connected to shutters 44NR, 44NY, and 44NG which control their red, yellow, and green lights, respectively. The east traffic light 36E is connected to shutters 46ER, 46EY, and 46EG. The south traffic light 38S is connected to shutters 48SR, 48SY, and 48SG. The west traffic light 40W is connected to shutters 50WR, 50WY, and 50WG.

In the preferred embodiment, the present invention may be retrofitted into existing traffic lights. The conventional light bulbs would be removed and replaced with shutters 44, 46, 48, and 50 that screw into each light bulb receptacle, so that the shutters are electrically controlled to open and close by the conventional switching control microprocessor 42 that is present.

DETAILED DESCRIPTION OF FIG. 4 SHOWING THE SECOND EMBODIMENT

Figure 4:
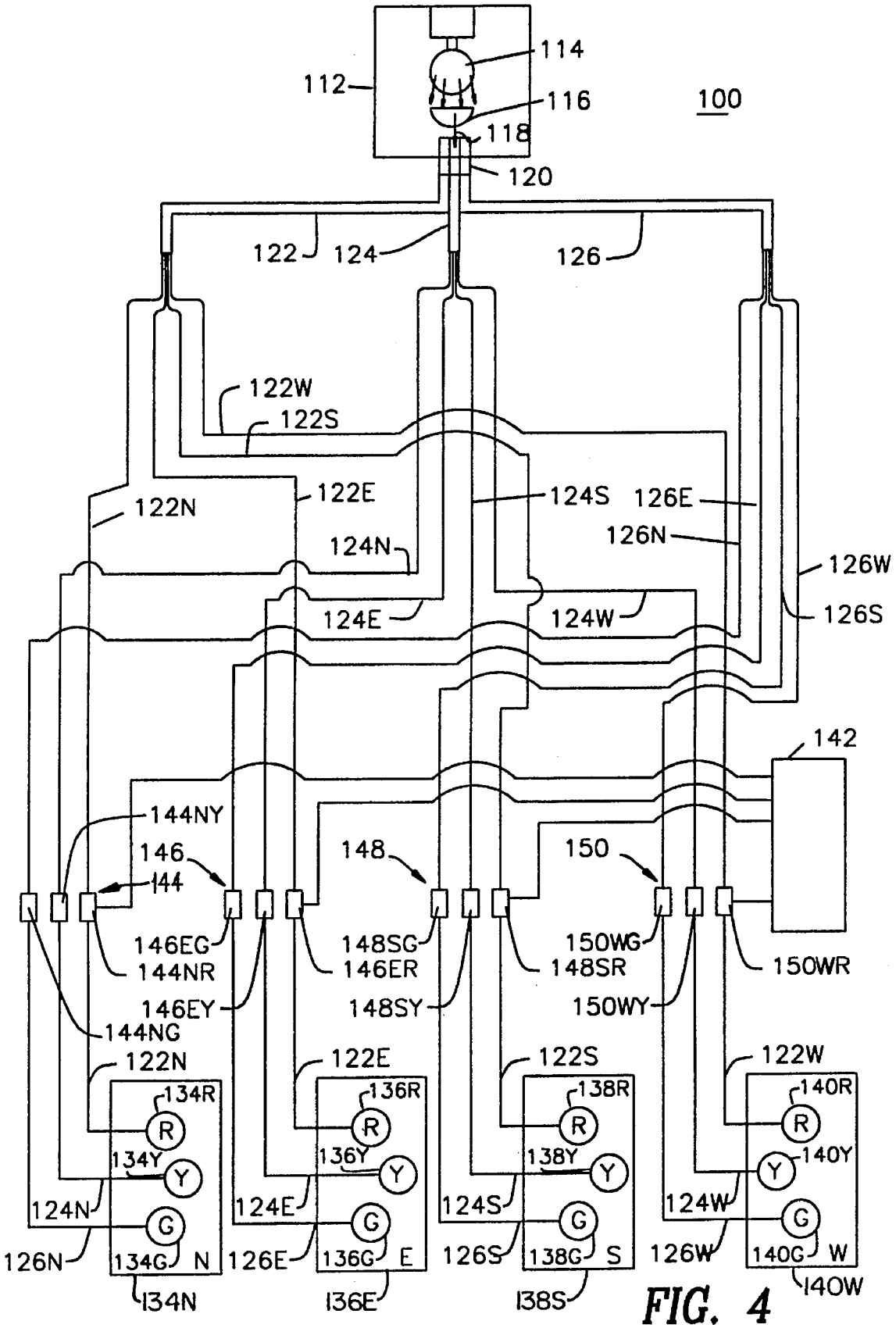
FIG. 4 is a schematic diagram of the second embodiment of the present invention showing the transmission of a light source to the fiber optic lines which connect to a plurality of traffic signal lights having fiber optic color display signals.

In this second embodiment 100, as shown by FIG. 4, all of the parts are the same as FIG. 3, except that in this embodiment, the fiber optic lenses of red, yellow, and green are mounted in their respective signal displays instead of the red, yellow, and green fiber optic lenses 28, 30, and 32 being located in the color multiplexer 27, as displayed in FIG. 3. More particularly, the red lens is placed and mounted within the red signals 134R, 136R, 138R, and 140R. Similarly, the yellow lens is placed and mounted within the yellow signals 134Y, 136Y, 138Y, and 140Y, and the green lens is placed and mounted within the green signals 134G, 136G, 138G, and 140G.

DETAILED DESCRIPTION OF FIG. 5 SHOWING THE THIRD EMBODIMENT

Figure 5:
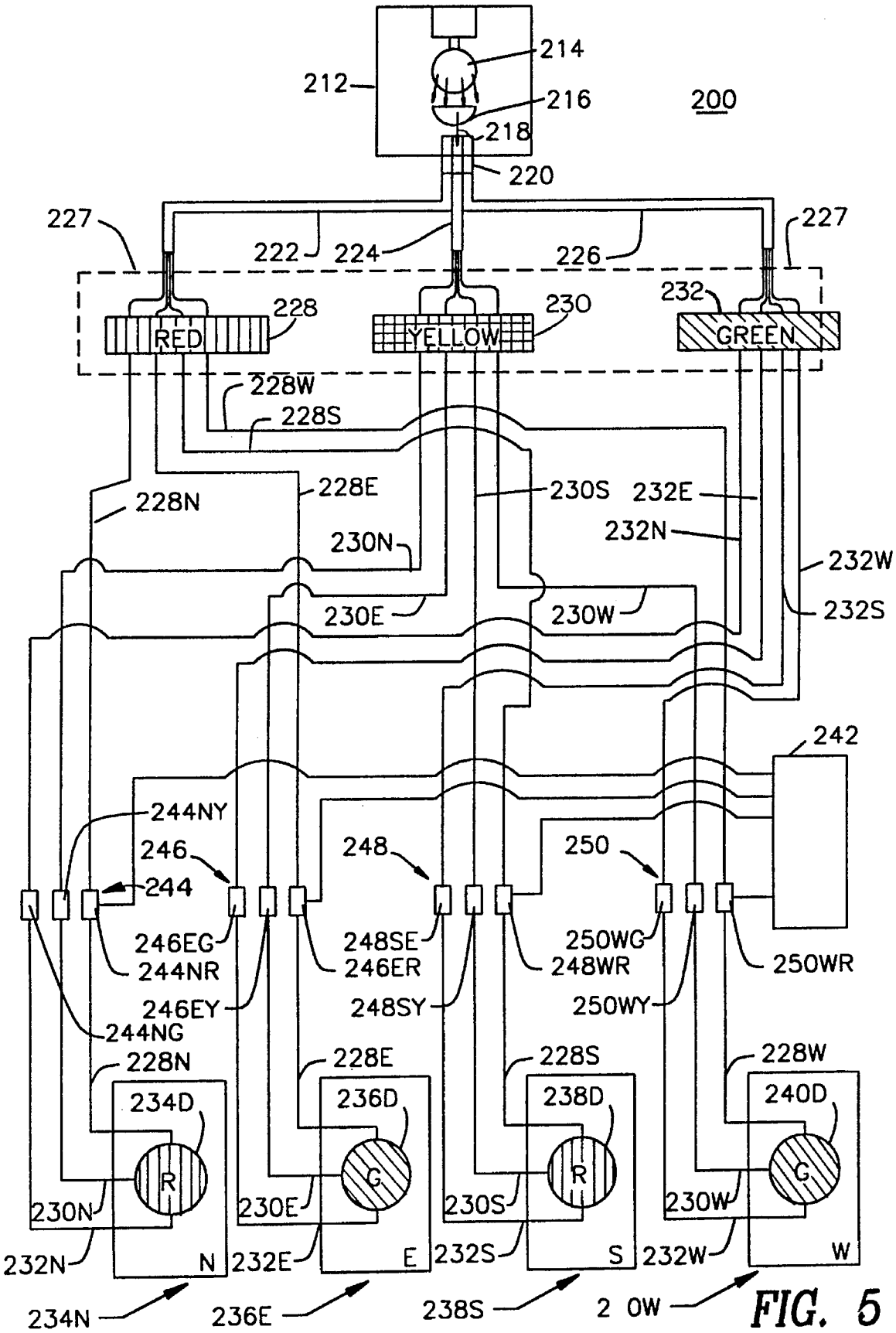
FIG. 5 is a schematic diagram of the third embodiment of the present invention showing the transmission of a light source to a plurality of fiber optic lines that transmit red, yellow, and green color light beams that connect to a plurality of traffic signal lights having a single display window.

In this third embodiment 200, as depicted in detail by FIG. 5, all of the parts are the same as FIG. 3, except that in this embodiment, there is a single signal display window for each traffic signal light instead of the red, yellow, and green signals displays of FIG. 3. More particularly, in this embodiment 200, there are single signal displays 234D, 236D, 238D, and 240D for traffic signal lights 234N, 236E, 238S, and 240W, respectively. The single signal displays can have a circular, oval, or octagonal shape. By way of example, FIG. 5 shows a plurality of circular single signal display windows.

DETAILED DESCRIPTION OF FIG. 7 SHOWING THE FOURTH EMBODIMENT

Figure 7:
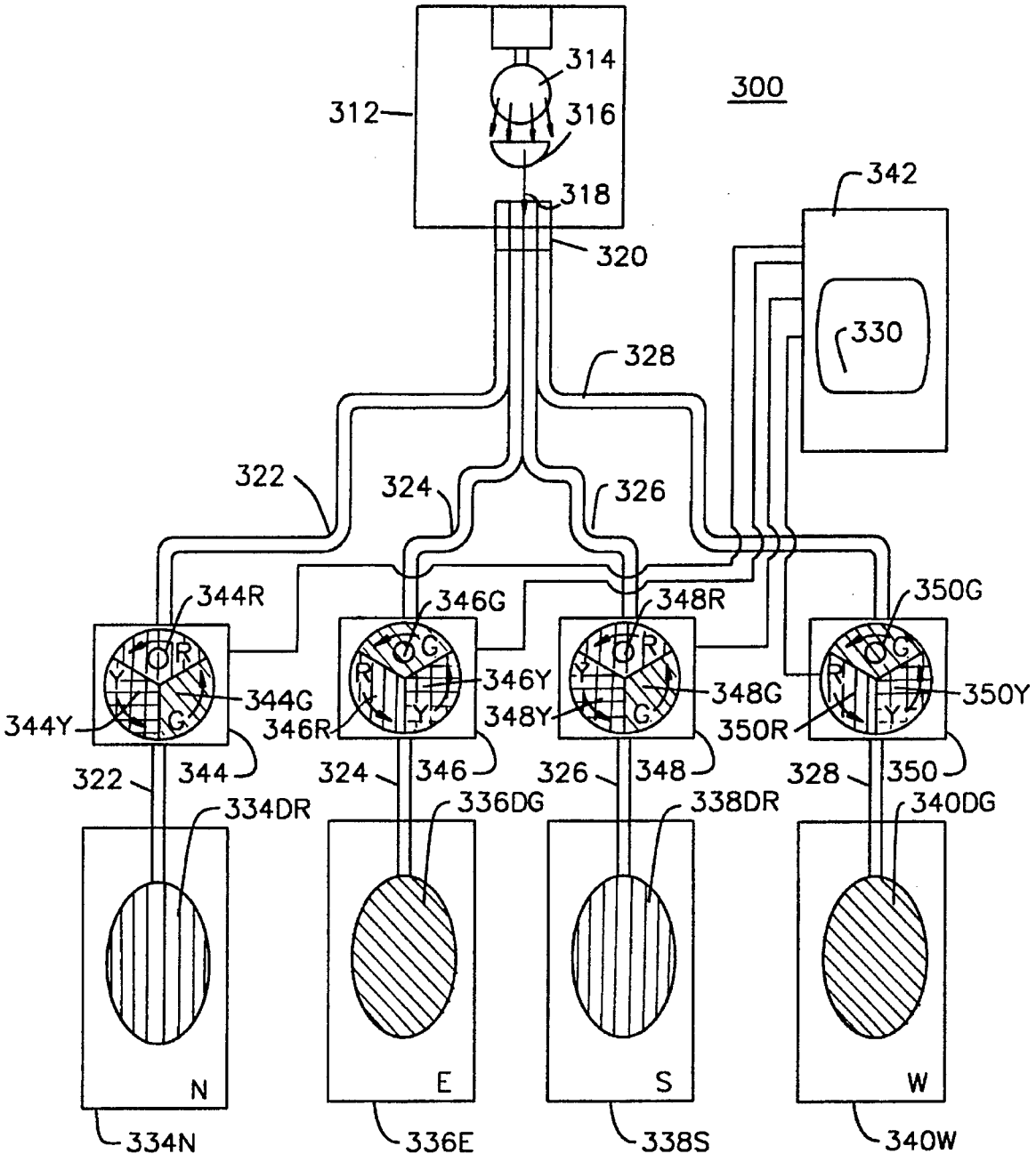
FIG. 7 is a schematic diagram of the fourth embodiment of the present invention showing the transmission of a light source to a plurality of fiber optic lines that transmit red, yellow, and green color light beams by way of a rotating lens wheel which connect to a plurality of single display traffic light signals.

This fourth embodiment 300, as shown by FIG. 7, differs substantially from FIG. 3 in the following areas:

1) In FIG. 7 of the fourth embodiment 300, there are four optic cables 322, 324, 326, and 328 within fiber optic conduit 320, whereas in FIG. 3 of the first embodiment 10, there are three optic cables 22, 24, and 26 within fiber optic conduit 20;

2) FIG. 7 of the fourth embodiment 300 has four rotating lens wheels 344, 346, 348, and 350 that have replaced the shutter components 44, 46, 48, and 50 of FIG. 3. Each rotating lens wheel (i.e., 344) has three colored fiber optic lenses being a red, yellow, and green lens 344R, 344Y, and 344G, respectively.

3) In FIG. 7 of the fourth embodiment 300, there is only a single fiber optic line 322, 324, 326, and 328 leaving each rotating lens 344, 346, 348, and 350, respectively, which transmits a given red, yellow, or green color light beam to a given light signal display, whereas in FIG. 3 of embodiment 10, there are a plurality of fiber optic lines 28N, 30N, 32N, 28E, 30E, 32E, 28S, 30S, 32S, 28W, 30W, and 32W which transmit a given red, yellow, or green color light beam to a predetermined signal display.

Figure 8:
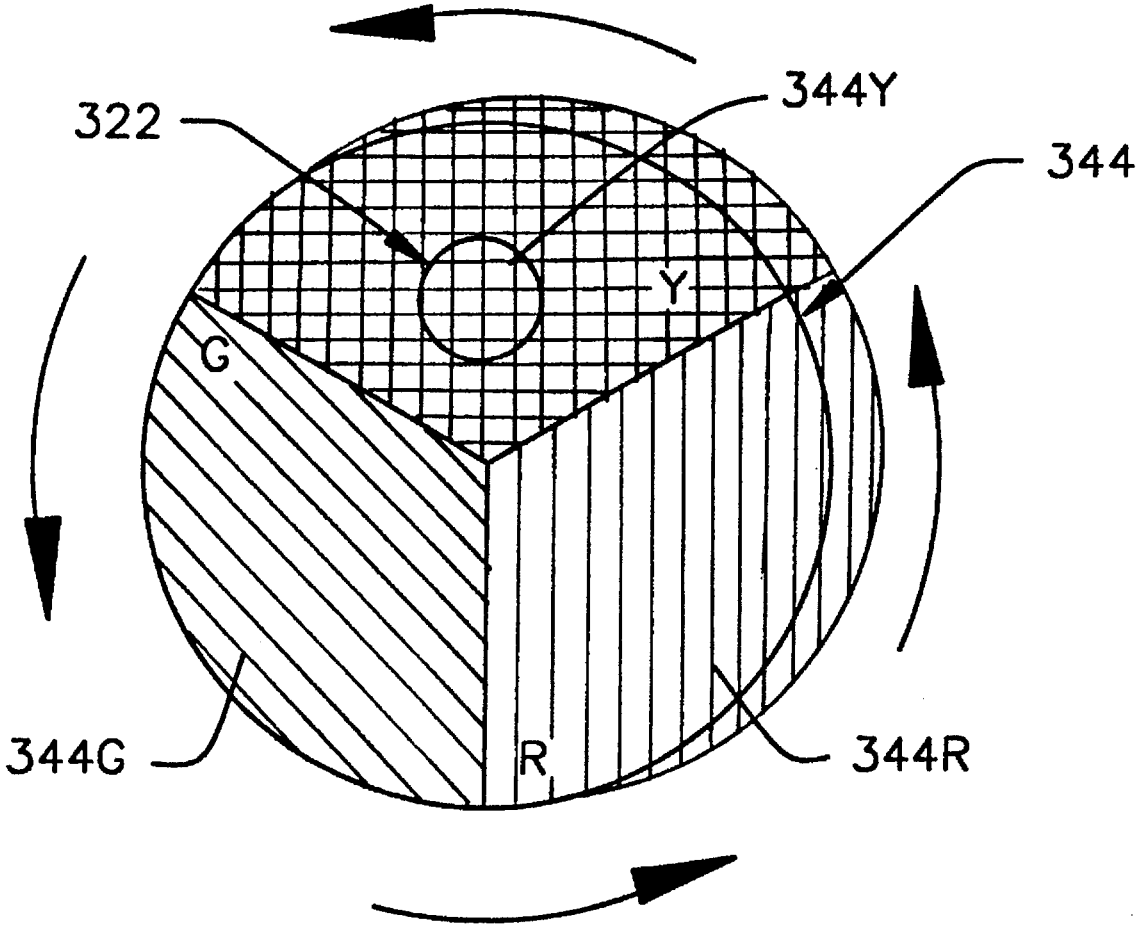
FIG. 8 is a perspective frontal view of a rotating lens wheel showing a fiber optic transmission line.
Figure 8A:
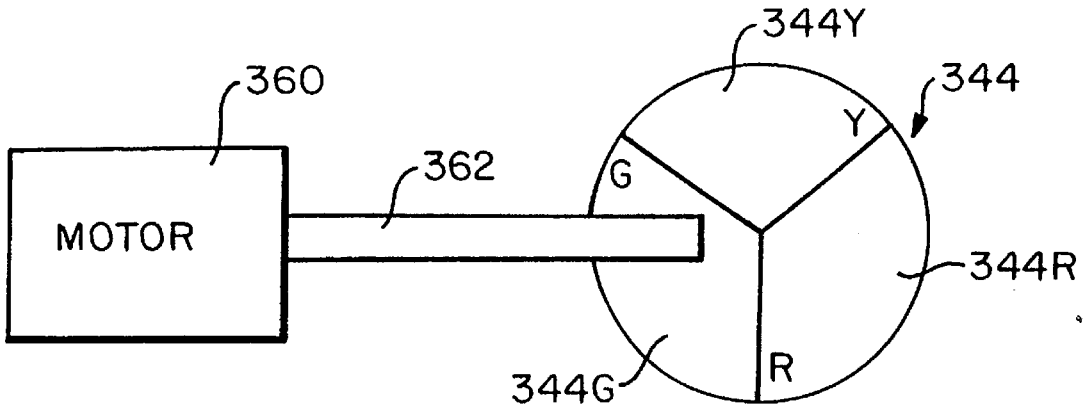

4) FIG. 7 of embodiment 300 is operated by a switching control microprocessor 342 having a logic circuit 330 for rotating the lens wheels 344, 346, 348, and 350 in a particular timed sequence versus a conventional switching control system 42 of FIG. 3. As shown in FIGS. 8 and 8A, an indexed stepper motor 360 having a shaft 362 may be used to rotate each of the lens wheels 344, 346, 348, and 350.

5) FIG. 7 of embodiment 300 has a plurality of traffic signal lights 334N, 336E, 338S, and 340W, each having a single signal display window 334D, 336D, 338D, and 340D that displays alternatively or in a timed sequence the red, yellow, and green color lights, whereas FIG. 3 shows a conventional traffic signal light having a red, yellow, and green display signal within each traffic light housing 34N, 36E, 38S, and 40W.

DETAILED DESCRIPTION OF FIG. 9 SHOWING THE FIFTH EMBODIMENT

Figure 10A:
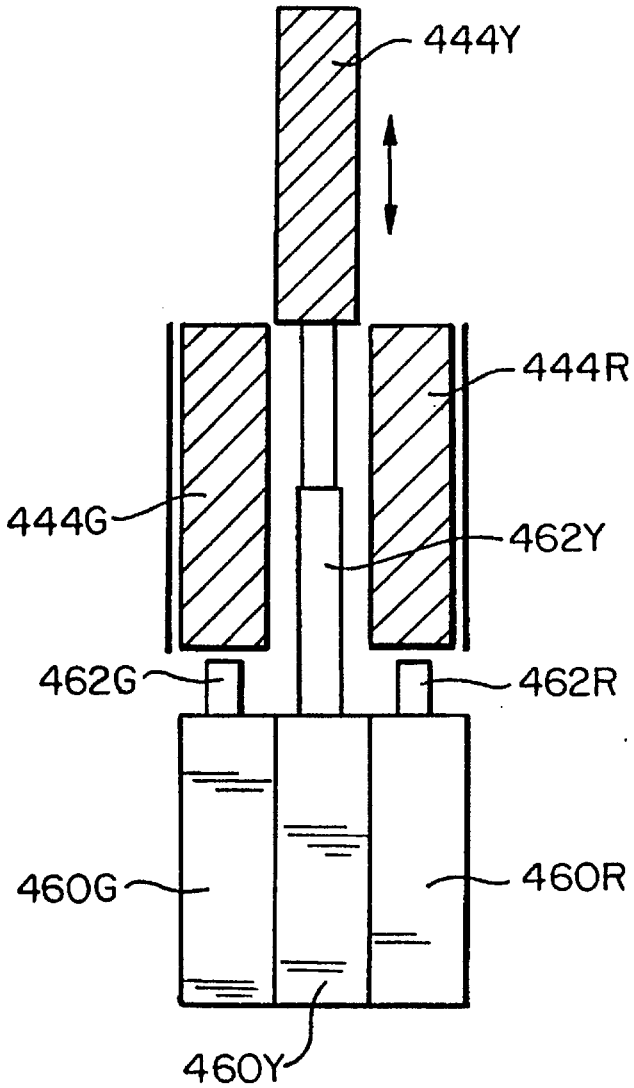
FIG. 10 is a perspective frontal view of a movable lens shutter showing the upward position of the yellow lens shutter.
Figure 9:
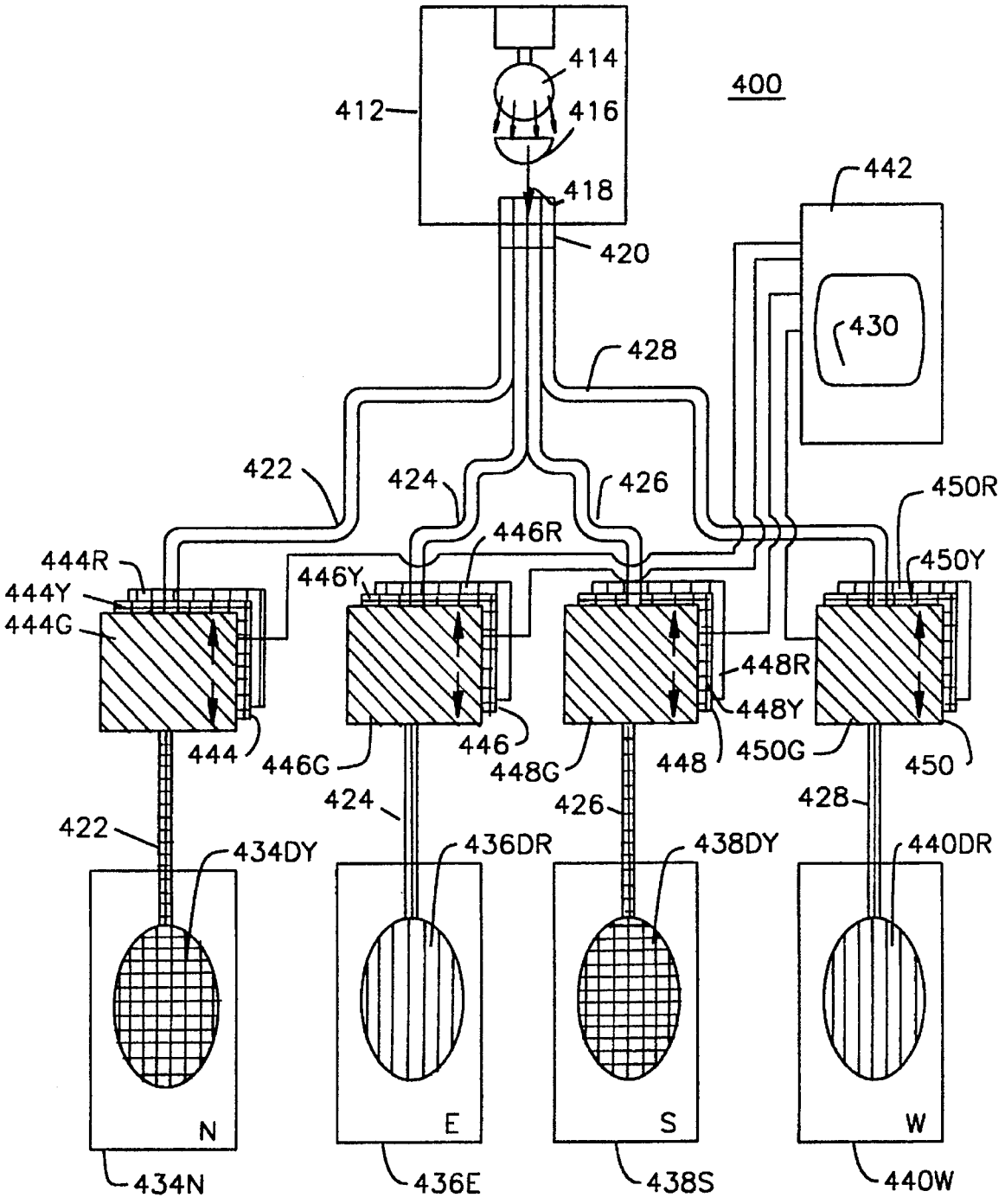
FIG. 9 is a schematic diagram of the fifth embodiment of the present invention showing the transmission of a light source to a plurality of fiber optic lines that transmit red, yellow, and green color light beams by way of a movable lens shutter which connect to a plurality of single display traffic light signals.
Figure 10:
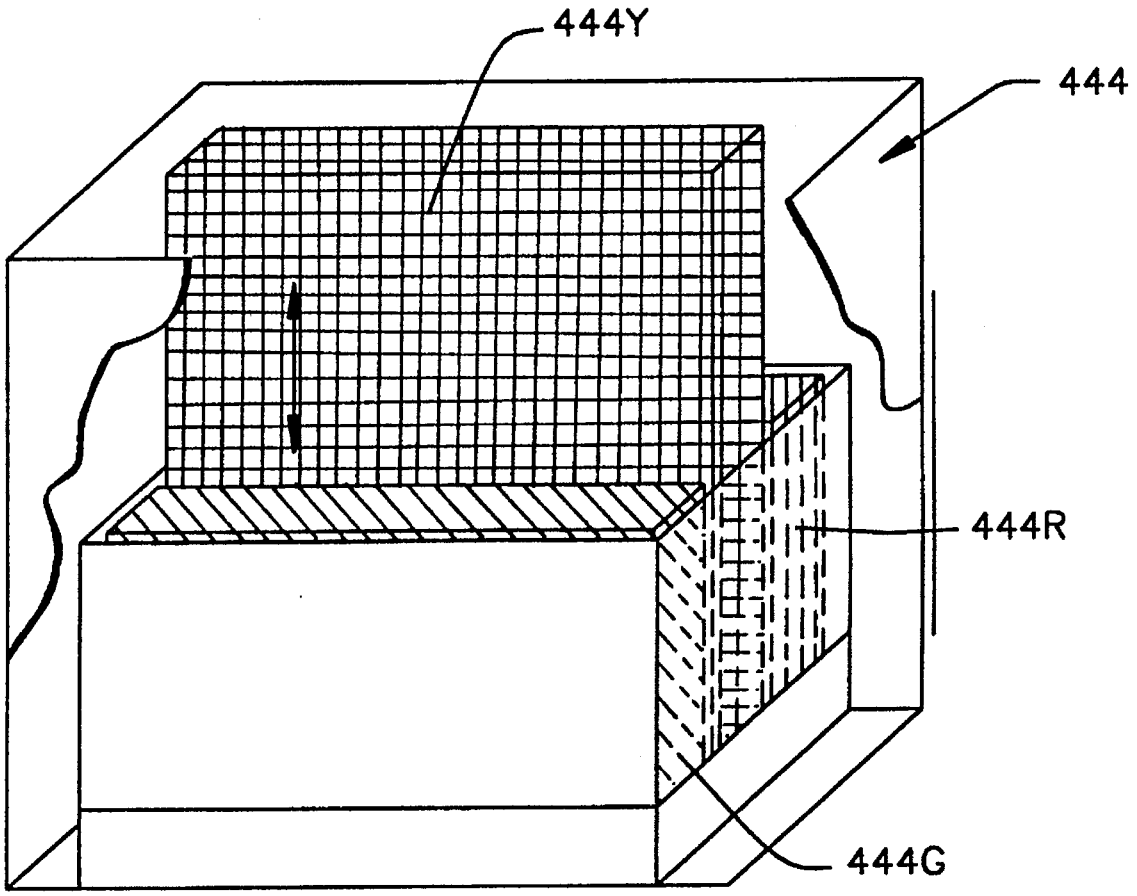

In this fifth embodiment 400, as depicted in detail by FIG. 9, all the parts are the same as FIG. 7, except in this embodiment, there are a plurality of movable lens shutters 444, 446, 448, and 450 instead of rotatable lens wheels 344, 346, 348, and 350, as shown in FIG. 7. More particularly, in this embodiment 400, each lens shutter component 444, 446, 448, and 450 has a green, yellow, and red lens that moves in an upward position to be in line with a fiber optic cable light source 422, 424, 426, and 428, which then transmits a particular green, yellow, or red color light beam. As shown in FIG. 10, the yellow lens shutter mechanism 444Y is in the upward in-line position to receive the light source transmission of cable 442 of lens shutter component 444. As shown in FIG. 10A, solenoids 460G, 460Y, and 460R having plungers 462G, 462Y, and 462R may be used to move each of the shutters 444 upwardly when energized and downwardly when de-energized.

In regard to the differences of FIG. 9 versus the first embodiment 10 of FIG. 3, the aforementioned differences are the same as in the FIG. 7 embodiment 300, except for the previously (above mentioned) described movable lens shutters 444, 446, 448, and 450 of FIG. 9.

DETAILED DESCRIPTION OF FIG. 11 SHOWING THE SIXTH EMBODIMENT

Figure 11:
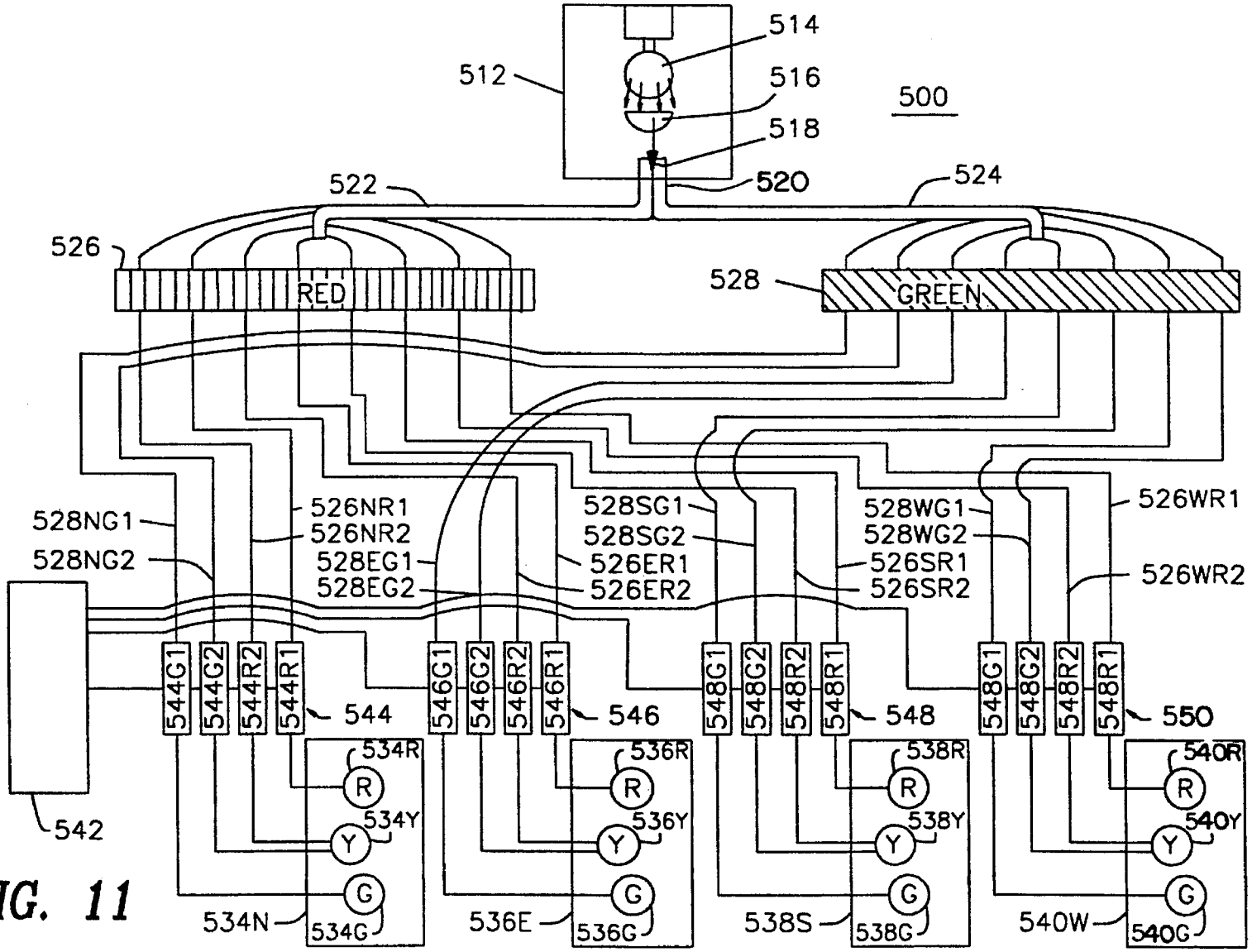
FIG. 11 is a schematic diagram of the sixth embodiment of the present invention showing the transmission of a light source to a plurality of fiber optic lines that transmit red and green color light beams which are mixed to produce a yellow output and are connected to a plurality of standard traffic light signals.

In this embodiment 500, as depicted in detail by FIG. 11, all the parts are the same as FIG. 3, except that in this embodiment, there are only red and green fiber optic lenses 526 and 528 instead of the red, yellow, and green fiber optic lenses 28, 30, and 32 located in the color multiplexer 27. The red and green lenses combine to produce yellow. In addition, the shutter controls 544, 546, 548, and 550, as shown in FIG. 11, each have four separate shutter control mechanisms which determine what color beam of red, green or yellow is transmitted to the signal displays of each traffic light 534N, 536E, 538S, and 540W. In the preferred embodiment, the shutter controls are solid state, and the displays are colorless so as to increase the contrast and reduce the need for sunshades and backplates.

More particularly, there are sixteen fiber optic lines 526NR1 to 528WG2, as shown in FIG. 11, which transmit red and green color beams through the shutter control components 544, 546, 548, and 550. By way of an example, shutter control component 544 can transmit various green and red color light beams by way of shutter control mechanisms 544G1, 544G2, 544R2, and 544R1 via fiber optic lines 528NG1, 528NG2, 526NR2, and 526NR1, respectively, which then in a timed sequence transmit a given color light beam to a particular signal display of traffic signal light 534N. The above structure follows this sequence, such that when shutter control mechanism 544R1 is in the OPEN position, a red color light beam is transmitted along fiber optic line 526NR1, which then lights the red signal display 534R. When shutter control mechanism 544R2 and 544G2 are in the OPEN position, red and green color light beams are transmitted along fiber optic lines 526NR2 and 528NG2 that are combined to produce a yellow light beam, which then lights the yellow display signal 534Y. When shutter control mechanism 544G1 is in the OPEN position, a green color light beam is transmitted along fiber optic line 528NG1, which then lights the green signal display 534G. The aforementioned shutter mechanisms 544R1, 544R2, 544G2, and 544G1 are controlled and operated by the switching control microprocessor 542 which operates in a particular timed sequence to traffic signal light 534N used in this example.

Figure 12:
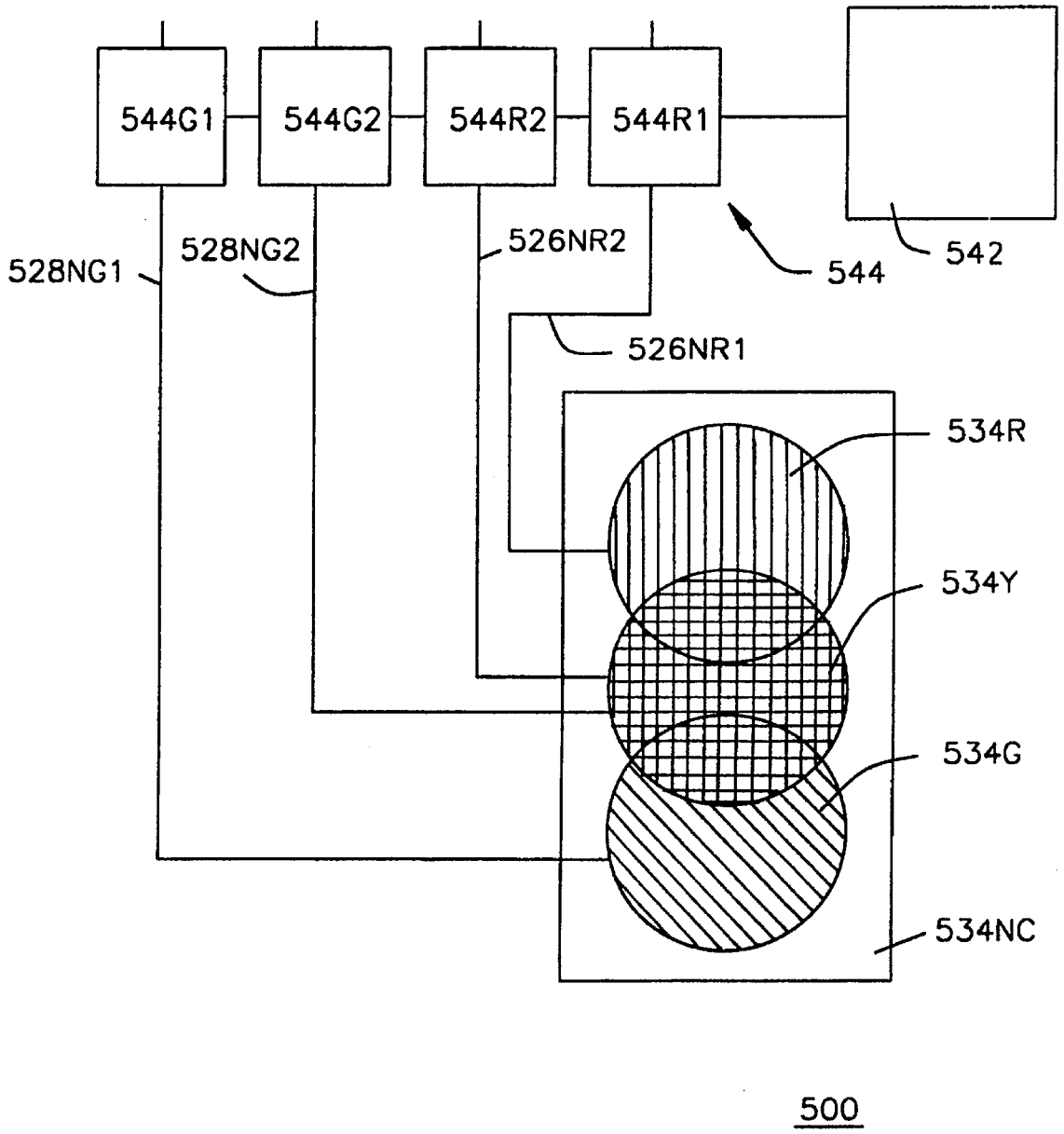
FIG. 12 is a schematic diagram of the sixth embodiment of the present embodiment of the present invention emphasizing the shutter mechanisms and fiber optic lines that transmit red and green color light beams to the traffic light which produce and transmit a red, yellow, and green signal display, along with showing a more compact traffic signal light housing.

As shown in FIG. 12, the traffic signal light 534NC depicts a more compact and reduced size (approximately a 40% size reduction) traffic light housing, i.e., 534N of FIG. 11, which is of conventional and standard size. Signal displays within housing 534N are such that signal displays 534R and 534G physically overlap the 534Y signal display area, which produces a more compact traffic signal light 534N. The circular signal displays 534R, 534Y, and 534G of traffic light 534NC can be between 8 to 12 inches in diameter.

Figure 13:
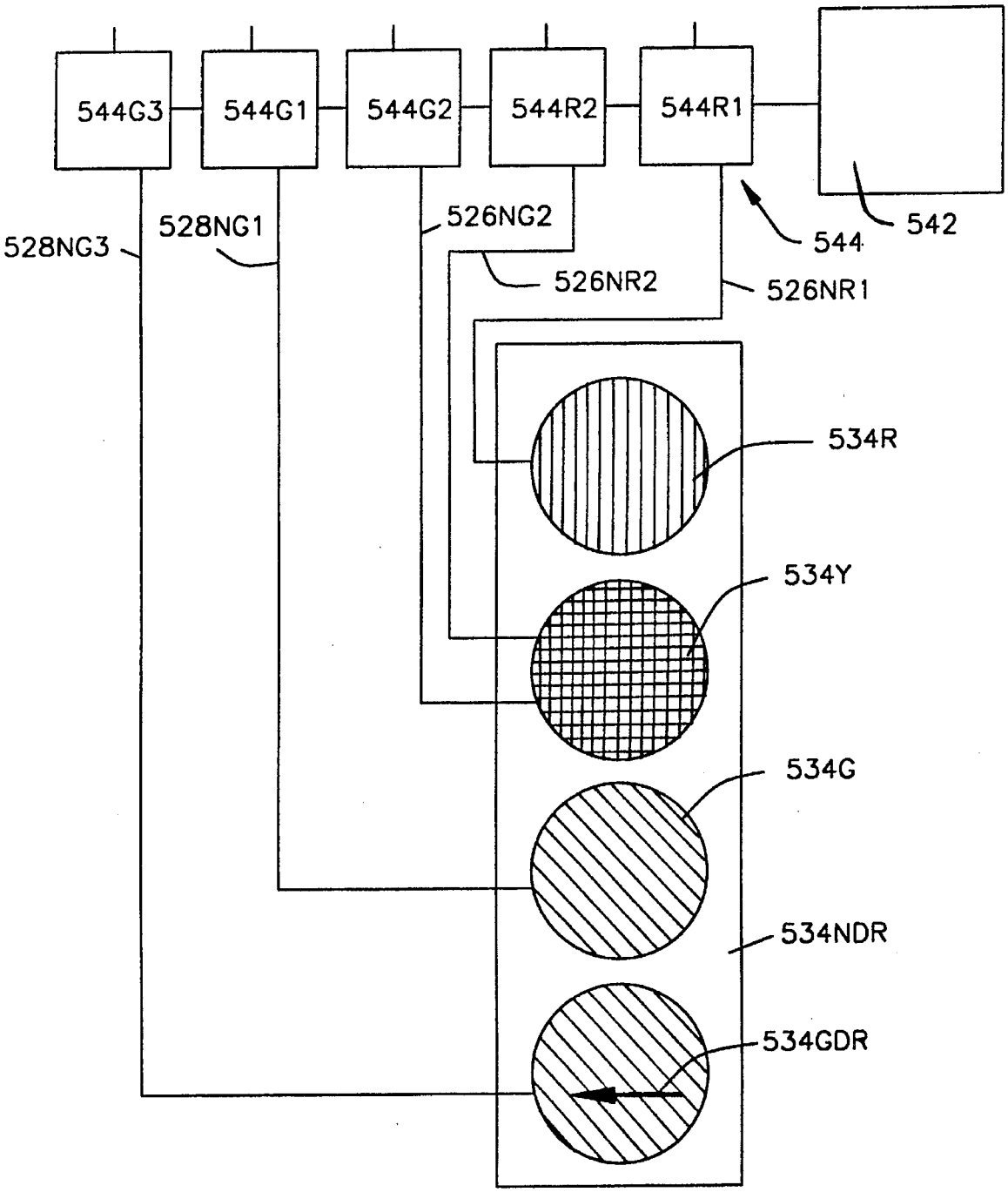
FIG. 13 is a schematic diagram of the sixth embodiment of the present invention emphasizing the shutter mechanisms and fiber optic lines that transmit red and green color light beams to the traffic light which produce and transmit a red, yellow, and green signal display, along with showing a traffic signal light housing having a left turn directional display.

As depicted in FIG. 13, all of the parts are the same as within the traffic light signal housing 534N of FIG. 11, except that in this embodiment, there is an additional green signal display 534GDr which shows a left turn directional arrow for the traffic light signal 534NDr. In addition, the green signal display 534GDr would have a separate shutter mechanism 544G3 that would transmit a green color beam on fiber optic line 528NG3 to the signal display 534GDr of traffic signal light 534NDr.

OPERATION OF THE PRESENT INVENTION

OPERATION OF FIG. 3 SHOWING THE FIRST EMBODIMENT 10

The traffic signal lights 34N, 36E, 38S, and 40W operate in a conventional sequence, using the fiber optics 20 and the shutter system 42 of the present invention, as shown by FIG. 3. By way of example, a typical sequence of operation will be described. Light source 12 is always on and light is always being transmitted on the twelve colored fiber optic lines 28N, 28E, 28S, 28W, 30N, 30E, 30S, 30W, 32N, 32E, 32S, and 32W. However, switching control microprocessor 42 controls shutters 44, 46, 48, and 50 to control which traffic signal lights 34N, 36E, 38S, and 40W actually receive the transmitted light.

In a typical timed sequence, when traffic lights 34N and 38S have their red signal lights 34R and 38R ON for a forty-five second timed interval, their respective shutters 44NR and 48SR are in the OPEN position, such that fiber optic lines 28N and 28S are transmitting a red color beam from the red fiber optic lens 28. Simultaneously, when traffic lights 36E and 40W have their green signal lights 36G and 40G ON for a thirty-five second timed interval, their respective shutters 46EG and 50WG are in the OPEN position, such that fiber optic lines 32E and 32W are transmitting a green color beam from the green fiber optic lens 32. After the green signal lights 36G and 40G from traffic lights 36E and 40W have been in the ON mode for thirty-five seconds, they are switched to a seven second yellow signal light sequence. The traffic lights 36E and 40W now have a yellow signal light 36Y and 40Y in the ON or lighted mode for seven seconds, and their respective shutters 46EY and 50WY are in the OPEN position, such that fiber optic lines 30E and 30W are transmitting a yellow color beam by way of the yellow fiber optic lens 30. After the seven seconds of the yellow signal lights 36Y and 40Y from traffic lights 36E and 40W being in the ON or lighted mode, they are then switched to a three second red signal light sequence. For the next three seconds, all traffic lights 34N, 36E, 38S, and 40W now have a red signal 34R, 36R, 38R, and 40R in the ON or lighted mode, where their respective shutters 44NR, 46ER, 48SR, and 50WR are in the OPEN position, such that fiber optic lines 28N, 28E, 28S, and 28W are transmitting a red color beam by way of the red fiber optic lens 28.

After the aforementioned three seconds have elapsed, traffic lights 36E and 40W stay on a red signal 36R and 40R for the next forty-seconds, while traffic lights 34N and 38S now turn to a green light signal 34G and 38G in an ON or lighted mode, where their respective shutters 44NG and 48SG are in the OPEN position for the next thirty-five seconds, such that fiber optic lines 32N and 32S are transmitting a green color beam by way of the green fiber optic lens 32.

After the green signal lights 34G and 38G from traffic signal lights 34N and 38S have been in the ON mode for thirty-five seconds, they are then switched to a seven second yellow signal light 34Y and 38Y sequence. The traffic lights 34N and 38S now have a yellow signal light 34Y and 38Y in the ON or lighted mode for seven seconds, and their respective shutters 44NY and 48SY are in the OPEN position, such that fiber optic lines 30N and 30S are transmitting a yellow color beam by way of the yellow fiber optic lens 30. After the seven seconds of the yellow signal lights 34Y and 38Y from traffic lights 34N and 38S being in the ON or lighted mode, they are then switched to a three second red signal light sequence. For the next three seconds, all traffic signal lights 34N, 36E, 38S, and 40W now have a red signal 34R, 36R, 38R, and 40R in the ON or lighted mode, where their respective shutters 44NR, 46ER, 48SR, and 50WR are in the OPEN position, such that fiber optic lines 28N, 28E, 28S, and 28W are transmitting a red color beam by way of the red fiber optic lens 28.

After the above three second sequence has elapsed, traffic signal lights 34N and 38S stay on a red signal light 34R and 38R for the next forty-seconds, which completes a full ninety second cycle of traffic lights 34N, 36E, 38S, and 40W going through their respective red, yellow, and green light sequences.

The timers of switching control microprocessor 42 can be programmed, such that traffic signal lights 34N, 36E, 38S, and 40W can have any predetermined timed sequence needed for a particular traffic intersection, depending upon the flow patterns of vehicular and pedestrian traffic.

OPERATION OF FIG. 4 SHOWING THE SECOND EMBODIMENT 100

As shown in FIG. 4 of the second embodiment 100, the traffic signal lights 134N, 136E, 138S, and 140W operate in a conventional sequence, using the fiber optics 120 and the shutter system 142 of the present invention. By way of an example, a typical sequence of operation was described above with regard to FIG. 3. Light source 112 is always on, and light is always being transmitted on the 12 fiber optic lines 122N, 122E, 122S, 122W, 124N, 124E, 124S, 124W, 126N, 126E, 126S, and 126W. The embodiment of FIG. 4 differs from FIG. 3 in that lenses 28, 30, and 32 of FIG. 3 are located and differently positioned in FIG. 4, such that they are mounted within each fiber traffic light 134N, 136E, 138S, and 140W. More particularly, the red lens is mounted in the red signals 134R, 136R, 138R, and 140R. Similarly, the yellow lens is mounted in the yellow signals 134Y, 136Y, 138Y, and 140Y. Similarly again, the green lens is mounted in the green signals 134G, 136G, 138G, and 140G. In all other respects, the embodiment of FIG. 4 operates in the same manner as the embodiment of FIG. 3.

OPERATION OF FIG. 5 SHOWING THE THIRD EMBODIMENT 200

Figure 6:
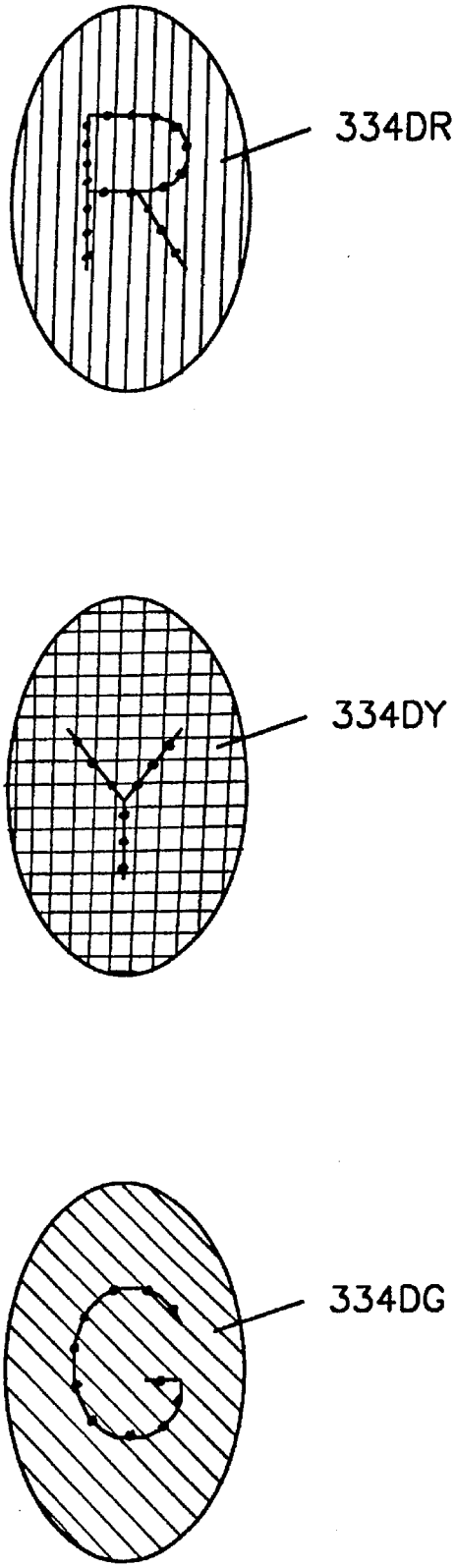
FIG. 6 is a front view of a single display window showing the letters "R", "Y", or "G" displayed with the appropriate red, yellow, and green color.

As shown in FIG. 5 of the third embodiment 200, the traffic signal lights 234N, 236E, 238S, and 240W operate in a conventional sequential manner, using the fiber optics 220 and the shutter control system 242 of the present invention. A typical sequence of operation was described above, with regard to FIG. 3. Light source 212 is always on, and light is always being transmitted on the 12 colored fiber optic lines 228N, 228E, 228S, 228W, 230N, 230E, 230S, 230W, 232N, 232E, 232S, and 232W. The embodiment of FIG. 5 differs from the embodiment of FIG. 3 in that the signal displays of FIG. 3 having separate red, yellow, and green displays, for example, 34R, 34Y, and 34G of a given traffic light 34N have been replaced in FIG. 5 by a single signal display window 234D, as depicted in FIG. 5. The single signal display windows 234D, 236D, 238D, and 240D transmit the correct colored signal in its proper sequence as controlled by the switching control microprocessor 242. The shutters 244, 246, 248, and 250 control which colored light is transmitted to the single display of traffic signal lights 234N, 236E, 238S, and 240W, i.e., red, yellow, or green. The aforementioned signal display windows 234D, 236D, 238D, and 240D can have a shape of an oval, circle, octagonal, triangle, or the like. In all other respects, the embodiment of FIG. 5 operates in the same manner as the embodiment of FIG. 3. Since there is only a single display for red, yellow, and green, FIG. 6 shows an arrangement whereby color blind people can distinguish which color light is being displayed. FIG. 6 shows the letters "R," "Y," or "G" displayed in the single display window with the appropriate color, so that a color blind person can distinguish between red, yellow, and green.

OPERATION OF FIG. 7 SHOWING THE FOURTH EMBODIMENT 300

As depicted in detail by FIGS. 7 and 8 of the fourth embodiment 300, the traffic signal lights 334N, 336E, 338S, and 340W operate in a conventional sequence, using the fiber optics 320 and the switching control system 342 having a logic circuit 330 within. By way of example, this fourth embodiment 300 will be described to show a typical sequence of operation. Light source 312 is always on, and light is being transmitted on the four optic fiber lines 322, 324, 326, and 328. Switching control system 342 in conjunction with the logic circuit 330 controls the rotating lens wheels 344, 346, 348, and 350 to rotate in a particular timed sequence. In this manner, as shown in FIGS. 6, 7, and 8, the red lens 344R, yellow lens 344Y, and green lens 344G each rotate to a position in line with fiber optic line 322 for the pre-set time periods for displaying a red, yellow, or green light signal at the single signal display window 334DR, 334DY, or 334DG. DR, DY, and DG designate "display red," "display yellow," and "display green," respectively. Each of the other rotating lens wheels 346, 348, and 350 operate in the same manner and use the same designations.

In a typical timed sequence for the fourth embodiment 300, when traffic lights 334N and 338S have their red display signal lights 334DR and 338DR ON for a forty-five second timed interval, their respective rotating lenses 344R and 348R are rotated to a lighted in-line position, such that fiber optic lines 322 and 326 are now transmitting a red color beam from the red fiber optic lens wheels 344R and 348R. Simultaneously, when traffic lights 336E and 340W have their green display signal lights 336DG and 340DG ON for a thirty-five second timed interval, their respective rotating lenses 346G and 350G are rotated to a lighted in-line position, such that fiber optic lines 324 and 328 are transmitting a green color beam from the green fiber optic lens wheels 346G and 350G. After the green signal lights 336DG and 340DG from traffic lights 336E and 340W have been in the ON mode for thirty-five seconds, they are switched to a seven second yellow signal light sequence. The traffic lights 336E and 340W now have a yellow signal light 336DY and 340DY in the ON position (which is an in-line lighted mode) for seven seconds, and their respective rotating lenses 346Y and 350Y are rotated to a lighted in-line position, such that fiber optic lens wheels 346Y and 350Y are now transmitting a yellow color beam by way of the lighted fiber optic lines 324 and 328. After the seven seconds of the yellow signal display lights 336DY and 340DY from traffic lights 336E and 340W being in the ON position (the lighted mode), they are then switched to a three second red signal display light sequence. For the next three seconds, all traffic lights 334N, 336E, 338S, and 340W now have a red display signal 334DR, 336DR, 338DR, and 340DR in the ON position, where their respective rotating lenses 344R, 346R, 348R, and 350R are rotated to the in-line position, such that fiber optic lines 322, 324, 326, and 328 are now transmitting a red color beam by way of the red fiber optic lens wheels 344R, 346R, 348R, and 350R.

After the aforementioned three seconds have elapsed, traffic lights 336E and 340W stay on a red display signal 336DR and 340DR for the next forty-five seconds, while traffic lights 334N and 338S now turn to a green light display signal 334DG and 338DG in an ON position, where their respective rotating lenses 344G and 348G are rotated to the in-line position for the next thirty-five seconds, such that fiber optic lines 322 and 326 are now transmitting a green color beam by way of the green fiber optic lens wheels 334G and 348G.

After the green signal display lights 334DG and 338DG from traffic signal lights 334N and 338S have been in the ON position for thirty-five seconds, they are then switched to a seven second yellow signal light 334DY and 338DY sequence. The traffic lights 334N and 338S now have a yellow signal light 334DY and 338DY in the ON position for seven seconds, and their respective rotating lenses 344Y and 348Y are rotated to a lighted in-line position, such that fiber optic lines 322 and 326 are now transmitting a yellow color beam by way of the yellow fiber optic lens wheels 344Y and 348Y. After the seven seconds of the yellow signal display lights 334DY and 338DY from traffic lights 334N and 338S being in the ON position, they are then switched to a three second red signal display light sequence. For the next three seconds, all traffic signal display lights 334DR, 336DR, 338DR, and 340DR now have a red signal in the ON mode, where their respective rotating lens wheels 344R, 346R, 348R, and 350R are rotated to a lighted in-line position, such that fiber optic lines 322, 324, 326, and 328 are now transmitting a red color beam by way of the red fiber optic lens wheels 344R, 346R, 348R, and 350R.

After the above three second sequence has elapsed, traffic signal lights 334N and 338S stay on a red signal display light 334DR and 338DR for the next forty-seconds, which completes a full ninety second cycle of traffic lights 334N, 336E, 338S, and 340W going through their respective red, yellow, and green light sequences.

The timers of switching control microprocessor 342 having a logic circuit 330 can be programmed, such that traffic signal lights 334N, 336E, 338S, and 340W can have any predetermined timed sequence needed for a particular traffic intersection, depending upon the flow patterns of vehicular and pedestrian traffic.

OPERATION OF FIG. 9 SHOWING THE FIFTH EMBODIMENT 400

As depicted in detail by FIGS. 9 and 10 of the fifth embodiment, the traffic signal lights 434N, 436E, 438S, and 440W operate in a conventional sequence, using the fiber optics 420 and the switching control system 442 having a logic circuit 430 within. By way of an example, a typical sequence of operation was described above with regard to FIG. 7. Light source 412 is always on, and light is being transmitted on the four optic fiber lines 422, 424, 426, and 428. Switching control system 442 in conjunction with the logic circuit 430 controls the movable lens shutters 444, 446, 448, and 450 to move in a particular timed sequence.

More particularly, the operation of the fifth embodiment 400, shown in FIG. 9, operates in the same manner as the fourth embodiment 300, as detailed by FIG. 7, except that the rotating lens wheels 344, 346, 348, and 350 have been replaced with movable lens shutters 444, 446, 448, and 450, as shown in FIG. 9. The lens shutters 444, 446, 448, and 450 also have green, yellow, and red lenses that move into position in the same timed sequence as described above with regard to FIG. 7.

As shown most clearly in FIG. 10, the desired lens shutter (for example, such as 444Y) moves upwardly to be in line with the fiber optic line 422, 424, 426, and/or 428 and to thereby transmit a yellow color beam to the light traffic signal display 434DY. The green and red lens shutters move upwardly in the same manner to be in line with the fiber optic lines 422, 424, 426, and 428 and to thereby transmit the appropriate sequential color. This entire operation and timed sequence is controlled by switching control microprocessor 442 with logic circuit 430.

OPERATION OF FIG. 11 SHOWING THE SIXTH EMBODIMENT 500

As shown by FIG. 11, the traffic signal lights 534N, 536E, 538S, and 540W operate in a standard sequential manner using the fiber optics 520 and the switching control system 542 of the sixth embodiment 500. By way of example, this sixth embodiment 500 will be described to show a typical sequence of operation. Light source 512 is always on, and light is always being transmitted on the sixteen color fiber optic lines 526NR1, 526NR2, 526ER1, 526ER2, 526SR1, 526SR2, 526WR1, 526WR2, 528NG1, 528NG2, 528EG1, 528EG2, 528SG1, 528SG2, 528WG1, and 528WG2. Switching control microprocessor 542 controls the shutters 544, 546, 548, and 550 to operate in a programmed timed sequence. The embodiment of FIG. 11 differs from FIG. 3 in that lenses 28, 30, and 32 of FIG. 3 have been reduced to only two lenses, one being a red fiber optic lens 526 and the other being a green fiber optic lens 528, as depicted in FIG. 11. More particularly, each traffic signal light 534N, 536E, 538S, and 540W of FIG. 11 correspondingly has four shutter mechanisms for each shutter component 544, 546, 548, and 550. For example, shutter component 544 of traffic light 534N has four shutter mechanisms 544R1, 544R2, 544G2, 544G1, as shown in detail by FIG. 12. Shutter mechanism 544R1 in the OPEN position transmit a red color beam to the traffic signal 534R. Shutter mechanisms 544R2 and 544G2 in the OPEN position transmit red and green color beams simultaneously, which produces a yellow color beam to the traffic signal 534Y. (As previously mentioned, red and green light produce a yellow colored light.) Shutter mechanism 544G1 in the OPEN position transmits a green color beam to the traffic signal 534G. As noted previously, FIG. 3 has three shutter mechanisms for each shutter component, i.e., traffic light 34N uses shutter component 44 having shutter mechanisms 44NR, 44NY, and 44NG, respectively, which transmits a red, yellow, and green color beam to the corresponding signal lights 34R, 34Y, and 34G.

In a typical timed sequence for the sixth embodiment 500, when traffic lights 534N and 538S have their red signal lights 534R and 538R ON for a forty-five second timed interval, their respective shutters 544R1 and 548R1 are in the OPEN position, such that fiber optic lines 526NR1 and 526SR1 are transmitting a red color beam from the red fiber optic lens 526. Simultaneously, when traffic lights 536E and 540W have their green signal lights 536G and 540G ON for a thirty-five second timed interval, their respective shutters 546G1 and 550G1 are in the OPEN position, such that fiber optic lines 528EG1 and 528WG1 are transmitting a green color beam from the green fiber optic lens 528. After the green signal lights 536G and 540G from traffic lights 536E and 540W have been in the ON mode for thirty-five seconds, they are switched to a seven second yellow signal light sequence. The traffic lights 536E and 540W now have a yellow signal light 536Y and 540Y in the ON or lighted mode for seven seconds, and their respective shutters 546R2 and 546G2 in conjunction with shutters 550R2 and 550G2 are in the OPEN position, such that fiber optic lines 526ER2 and 528EG2 along with 526WR2 and 528WG2 are producing and transmitting a yellow color beam by way of the red and green fiber optic lenses 526 and 528. After the seven seconds of the yellow signal lights 536Y and 540Y from traffic lights 536E and 540W being in the ON or lighted mode, they are then switched to a three second red signal light sequence. For the next three seconds, all traffic lights 534N, 536E, 538S, and 540W now have a red signal 534R, 536R, 538R, and 540R in the ON or lighted mode, where their respective shutters 544R1, 546R1, 548R1, and 550R1 are in the OPEN position, such that fiber optic lines 526NR1, 526ER1, 526SR1, and 526WR1 are transmitting a red color beam by way of the red fiber optic lens 526.

After the aforementioned three seconds have elapsed, traffic lights 536E and 540W stay on a red signal 536R and 540R for the next forty-seconds, while traffic lights 534N and 538S now turn to a green light signal 534G and 538G in an ON or lighted mode, where their respective shutters 544G1 and 548G1 are in the OPEN position for the next thirty-five seconds, such that fiber optic lines 528NG1 and 528SG1 are transmitting a green color beam by way of the green fiber optic lens 528.

After the green signal lights 534G and 538G from traffic signal lights 534N and 538S have been in the ON mode for thirty-five seconds, they are then switched to a seven second yellow signal light 534Y and 538Y sequence. The traffic lights 534N and 538S now have a yellow signal light 534Y and 538Y in the ON or lighted mode for seven seconds, and their respective shutters 544R2 and 544G2 in conjunction with shutters 548R2 and 548G2 are in the OPEN position, such that fiber optic lines 526NR2 and 528NG2 along with fiber optic lines 526SR2 and 528SG2 are producing and transmitting a yellow color beam by way of the red and green fiber optic lenses 526 and 528. After the seven seconds of the yellow signal lights 534Y and 538Y from traffic lights 534N and 538S being in the ON or lighted mode, they are then switched to a three second red signal light sequence. For the next three seconds, all traffic signal lights 534N, 536E, 538S, and 540W now have a red signal 534R, 536R, 538R, and 540R in the ON or lighted mode, where their respective shutters 544R1, 546R1, 548R1, and 550R1 are in the OPEN position, such that fiber optic lines 526NR1, 526ER1, 526SR1, and 526WR1 are transmitting a red color beam by way of the red fiber optic lenses 526.

After the above three second sequence has elapsed, traffic signal lights 534N and 538S stay on a red signal light 534R and 538R for the next forty-seconds, which completes a full ninety second cycle of traffic lights 534N, 536E, 538S, and 540W going through their respective red, yellow, and green light sequences.

The timers of switching control microprocessor 542 can be programmed, such that traffic signal lights 534N, 536E, 538S, and 540W can have any predetermined timed sequence needed for a particular traffic intersection, depending upon the flow patterns of vehicular and pedestrian traffic.

As depicted in FIG. 12 of the sixth embodiment 500, fiber optic traffic signal lights 534N, 536E, 538S, and 540W of FIG. 11 have been replaced with another housing embodiment of a traffic signal light 534NC (536EC, 538SC, and 540WC not shown) of FIG. 12, such that there is an approximate 40% size reduction in the housing height over the traffic signal lights 534N, 536E, 538S, and 540W. Signal displays 534R and 534G physically overlap the 534Y signal display area to produce a more compact traffic signal light 534NC, in which the circular display diameters of 534R, 534Y, and 534G can be between 8 inches to 12 inches.

As depicted in FIG. 13 of the sixth embodiment 500, fiber optic traffic signal lights 534N, 536E, 538S, and 540W of FIG. 11 have been replaced with still another housing embodiment of a traffic signal light 534NDr (536EDr, 538SDr, and 540WDr not shown) of FIG. 13, such that there is an additional green signal display 534GDr in traffic signal housing 534NDr. Green signal display 534GDr has a left turn directional arrow for making a left turn when the signal display 534GDr is in the ON mode. The green signal display 534GDr has a separate shutter mechanism 544G3 that transmits a green color beam in the form of an arrow on fiber optic line 528NG3 to the signal display 534GDr of traffic light 534NDr. In all other respects, the embodiments shown in FIGS. 12 and 13 of the sixth embodiment 500 operate in the same manner as the embodiment of FIG. 11.

It should be noted that the directional display 534GDr of FIG. 13 could have additional display colors or signs, such as red or yellow arrows, in conjunction with additional shutter mechanisms and fiber optic lines to produce and transmit the red and/or yellow arrows for a given traffic light signal 534NC, etc.

ADVANTAGES OF THE PRESENT INVENTION

The primary advantage of the present invention is that the fiber optic traffic signal light system utilizes a conventional switching control microprocessor for controlling a plurality of shutters to open and close in a predetermined timed sequence which maximizes the flow of vehicular and pedestrian traffic for a given direction while minimizing congestion for a traffic intersection.

Another advantage of the present invention is that using the projector apparatus 12 having a single high-intensity discharge lamp 14 with a convergence lens 16 replaces twelve or more bulbs in a conventional traffic light system. The use of one high-intensity lamp 14 in this traffic light system 10 minimizes costs of replacement parts and bulbs, and repairs to the equipment, and provides lower costs for labor expenses for on-going maintenance of the system.

Another advantage of the present invention is that it uses a single, high-intensity, 70 watt discharge lamp 14, whereas a conventional traffic light system may be using twelve or more 80 watt bulbs, providing a power savings of 70 watts to 320 or 400 watts. The conventional traffic light system uses many times more power, whereas the present invention provides a substantial cost savings in energy consumption.

Another advantage of the present invention is that it uses a single signal display window for illuminating a red, yellow, or green light signal to provide a more compact and lightweight housing. Also, conventional traffic light signal displays are smaller in size and do not have the same visibility as the present invention.

Another advantage of the present invention is that it uses a fiber optic traffic signal light system with a shutter switching control having a logic circuit that is lightweight, compact, easy to maintain, and which minimizes labor costs and costs of parts.

Still another advantage of the present invention provides for the use of a color multiplexer having fiber optic red, yellow, and green lenses, which enhance the colored light illumination to an optimal lighting level, making the traffic signal lights easier to see at greater distances versus conventional colored signal lights.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A fiber optic traffic signal light control system, comprising:

a) a light source including at least one high-intensity lamp;

b) movable red, yellow, and green lenses;

c) fiber optic cables for receiving light from said light source and connected to said red, yellow, and green lenses, respectively, to provide sources of red, yellow and green signal lights;

d) at least one traffic signal light connected to said lenses, each having a single display for displaying said red, yellow, and green signal lights; and e) switching control means connected to said lenses for moving said lenses in a predetermined sequence for predetermined time periods to control the supply of red, green, and yellow light to each of said single displays in said traffic signal lights.

2. A fiber optic system in accordance with claim 1, wherein said lenses rotate.

3. A fiber optic traffic signal light control system, comprising:

a) a light source including at least one high-intensity lamp;

b) movable red, yellow, and green shutters;

c) fiber optic cables for receiving light from said light source and connected to said red, yellow, and green shutters, respectively, to provide sources of red, yellow and green signal lights;

d) at least one traffic signal light connected to said shutters, each having a single display for displaying said red, yellow, and green signal lights; and e) switching control means connected to said shutters for moving said shutters in a predetermined sequence for predetermined time periods to control the supply of red, green, and yellow light to each of said single displays in said traffic signal lights.

* * * * *